United States Patent [19]

Bies et al.

[11] 4,450,961

[45] May 29, 1984

[54] DISPLAY BRACKET FOR SOCKET DRIVE UNITS AND PACKAGE EMPLOYING SAME

[75] Inventors: Sylvester W. Bies, Bloomfield; Martin V. Fazio, Cheshire; George Matyczyk, Southington, all of Conn.

[73] Assignee: The Stanley Works, New Britain, Conn.

[21] Appl. No.: 400,891

[22] Filed: Jul. 22, 1982

[51] Int. Cl.[3] ..... B65D 75/56; B65D 85/20

[52] U.S. Cl. ..... 206/349; 206/468; 206/480; 206/493; 206/806; 211/69

[58] Field of Search ..... 206/328, 349, 468, 480, 206/493, 806, 60 T; 211/69; 294/87.26, 87 R

[56] References Cited

U.S. PATENT DOCUMENTS

| | | | |
|---|---|---|---|
| 772,609 | 3/1903 | McIntyre | 206/493 |
| 1,566,240 | 12/1925 | Walter | 206/327 |
| 2,731,229 | 1/1956 | Seitz | 206/349 |
| 2,855,107 | 10/1958 | Roth | 211/60 R |
| 3,516,585 | 6/1970 | Inwood | 206/349 |
| 3,880,283 | 4/1975 | Flaherty et al. | 206/45.19 |
| 3,927,765 | 12/1975 | Beal | 206/493 |
| 4,019,632 | 4/1977 | Greenlee | 206/349 |
| 4,069,915 | 1/1978 | Schurman | 206/305 |
| 4,373,628 | 2/1983 | Dantes | 206/349 |
| 4,378,068 | 3/1983 | Bell | 206/461 |

FOREIGN PATENT DOCUMENTS

| | | | |
|---|---|---|---|
| 2435010 | 2/1976 | Fed. Rep. of Germany | 206/349 |
| 2417456 | 9/1979 | France | 294/87.26 |
| 1525155 | 9/1978 | United Kingdom | 206/806 |

*Primary Examiner*—William T. Dixson, Jr.
*Assistant Examiner*—Brenda J. Ehrhardt

[57] ABSTRACT

An assembly for holding a socket driver, an extension, or a spinner includes an L-shaped bracket member which has means thereon for engaging either the head or the shank portion of the tool. The assembly also includes a slide locking member that is engaged with a support wall of the bracket, to trap another portion of the tool (the shank or a section of the handle) and thereby retain the tool in the assembly. The package is adapted for point of sale display to present the article to the customer in an attractive manner, while protecting it against physical damage and pilferage; the slide locking member is capable of removal without damage to the assembly, thereby permitting reuse for storage of the tool part by the purchaser.

25 Claims, 12 Drawing Figures

DISPLAY BRACKET FOR SOCKET DRIVE UNITS AND PACKAGE EMPLOYING SAME

BACKGROUND OF THE INVENTION

Because socket drivers and related tools and parts are frequently scld separately, it is necessary that packaging be provided that will not only protect the part, but will also securely hold it, permit its identification, and present it to the customer in an attractive manner. Although it is important that the contained article be capable of convenient removal from the display package by the customer, it is also desirable that there be provided substantial inhibition to removal in the store, so as to discourage pilferage. It is also important, for economic and other self-evident reasons, that the package be of relatively simple and inexpensive construction.

To the consumer, it is often desirable that means be available by which the tools that he uses can be conveniently organized and neatly stored. Thus, manufacturers recognize the benefits that can be derived from using a package that not only permits point of sale display in a desirable manner, but that is also capable of reuse by the customer for subsequent storage of the purchased article. To achieve that end, it is of course necessary that the packaging be suitably designed for the purpose, and that it not be damaged or destroyed in the course of initial removal of the goods; it is also important that the article be readily mounted and removed.

A display hanger for a socket wrench tool, such as a ratchet handle, is described in Greenlee U.S. Pat. No. 4,019,632. The patented device consists of a frame-like member, within which the head of the tool is received; a rectangular strip is used in cooperation with a bottom portion of the structure to create an annular collar in which the stem of the tool is received and secured. While the device of the Greenlee patent may be satisfactory for its intended purposes, it is to be noted that it provides virtually no protection for the packaged tool, and that it is necessarily destroyed during initial opening, thereby precluding its reuse for storage purposes. The Greenlee device also offers little by way of aesthetic appeal.

Accordingly, it is a primary object of the present invention to provide a novel display bracket assembly for holding a socket drive unit, which bracket assembly is adapted for packaging of the article to protect it against damage, while securely holding the article and presenting it to the consumer in an attractive manner.

It is also an object of the invention to provide such an assembly which will securely retain the packaged article and discourage pilferage, while nevertheless permitting facile removal by the customer.

Another object of the invention is to provide a novel bracket assembly which serves not only as packaging for point of sale display of the article, but is also suited for its subsequent storage.

Yet another object of the invention is to provide a bracket assembly having the foregoing features and advantages, which is also relatively simple and is adapted for facile and inexpensive manufacture.

A further object of the invention is to provide a novel display package, wherein a socket driver, a socket driver extension, or a socket spinner is held within a bracket assembly, and is thereby protected and presented to the customer in an attractive and yet secure manner.

SUMMARY OF THE INVENTION

It has now been found that certain of the foregoing and related objects of the present invention are readily attained in a display bracket comprised of a generally L-shaped bracket member and a slide member engaged therewith. The bracket member includes a rear wall and a laterally extending support wall adjacent one end thereof, the rear wall having means spaced from the support wall for engaging a first portion of the tool, and the support wall having a channel extending inwardly from one of its edges for receiving a second portion of the tool. The slide member is slidably engaged on the support wall of the bracket member, and has a transverse portion that extends across the channel of the support wall along the "one" edge thereof. As a result, the support wall channel is blocked by the transversely extending portion of the slide member, with the second portion of the tool thereby being trapped therewithin.

For a socket driver, the engaging means of the rear wall of the bracket will generally comprise an opening that is dimensioned and configured to seat a laterally projecting part of its head portion; typically, the opening will be square. When, alternatively, the assembly is to be used to hold a socket extension or adapter, the engaging means may comprise the combination of a hook-shaped member projecting towards the support wall, and a supporting collar disposed adjacent the hook-shaped member and towards the support wall. In such a structure, the head portion of the tool will be supported on the collar, with the hook-shaped member inserted axially into the socket thereof. Finally, for a socket spinner, the engaging means may be a collar that partially encircles the shaft portion of the tool.

In the preferred embodiments, the assembly will additionally include means for disengageably locking the slide member in assembly with the bracket member, a particularly desirable form of locking means including at least one resiliently deflectable tab portion, on either the bracket member or the slide member, designed to engage with the other one thereof. The slide member may itself include a plate that is slidably mounted upon the support wall of the bracket, and that has a slot extending inwardly from its leading edge. The slide member slot will cooperate with the channel of the support wall to define an opening through which the second portion of the tool passes when it is held in the assembly. Generally, the channel and slot of the support wall and the plate will both be of generally U-shaped configuration, so as together define a substantially circular opening for the tool portion.

In the particularly preferred embodiments of the assembly, the plate of the slide member will be disposed against the support wall of the bracket; the tab portion will normally be located on the slide member, and will include an upstanding locking dog disposed to snap behind the support wall. Most desirably, the slide member will have two of such tab portions or prongs thereon, the inner edges of which partially define the slot in the plate. In such embodiments, the undersurface of the support wall, contiguous to the channel therein, will advantageously have tapered surface portions to provide a lead-in path, to accomodate the upstanding locking dogs of the tab portions and to facilitate insertion of the slide member.

Normally, the bracket will include structure defining a pair of confronting parallel channel portions on the surface thereof spaced from the seating means, for engagement of the slide member, the side edges of the plate thereof being dimensioned and configured for sliding movement therewithin. The portions of the side edges adjacent the "one" edge thereof will desirably be tapered both inwardly and towards the seating means, the inward taper facilitating lateral entry of the slide member into the channel portions, and the second taper permitting facile entry of the slide member angled towards the seating means, the latter serving to better accommodate the upstanding locking dogs of the slide member tab portions.

Additional objects of the invention are attained by the provision of a display package, including a display bracket assembly and a tool, both as hereinabove described. In the package, either the head portion or the shank portion (depending upon the particular tool) is engaged by the engaging means of the rear wall of the L-shaped bracket, and either the shank portion or a section of the handle is trapped within the channel of the support wall by the slide member.

DETAILED DESCRIPTION OF THE PREFERRED AND ILLUSTRATED EMBODIMENTS

Figure 1:
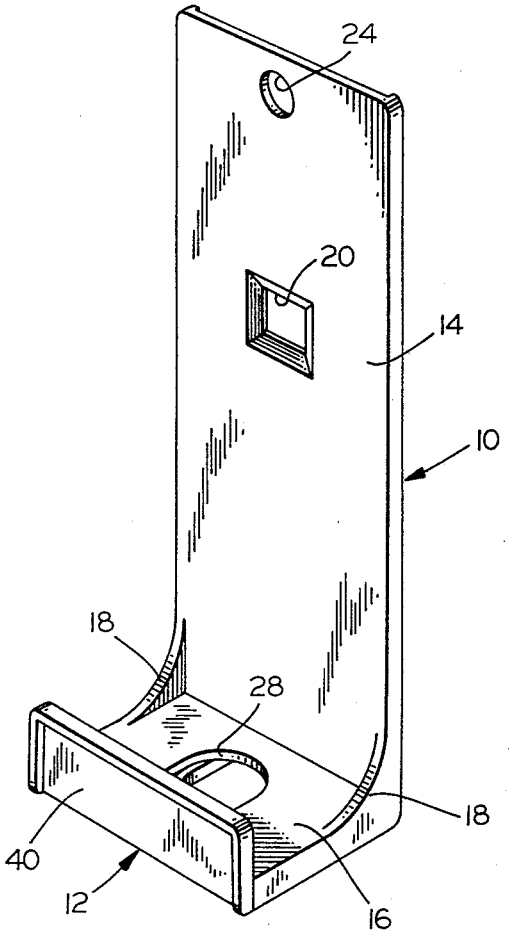
FIG. 1 is a perspective view of a bracket assembly for a socket driver, embodying the present invention.
Figure 2:
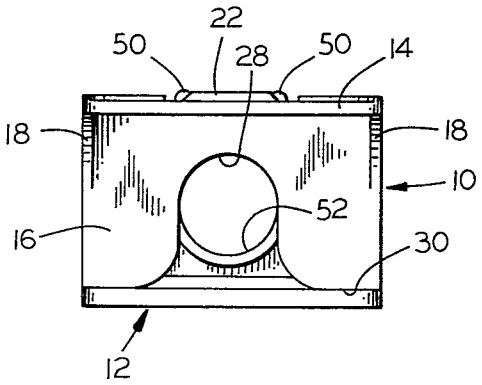
FIG. 2 is a top plan view of the assembly of FIG. 1.

Turning initially to FIGS. 1-8 of the drawings, therein illustrated is one embodiment of the invention, the bracket assembly shown being adapted to hold a socket driver. The assembly consists of an L-shaped bracket member, generally designated by the numeral 10, and a slide member, generally designated by the numeral 12, engaged thereupon. The bracket member 10 consists of a rear wall 14 and a support wall 16, the latter projecting laterally from the lower end of the former; curved web portions 18 provide reinforcement at the juncture of the walls 14, 16. The rear wall 14 has an inwardly tapered square opening or seat 20 formed therein, which is reinforced by a raised rectangular frame portion 22 on the rear surface of the rear wall. Above the opening 20 is a relatively small circular hole 24, which is provided to receive a hook for mounting the display package upon suitable support structure, such as a peg-board. As can best be seen in FIG. 4, the lateral edges of the rear wall 14 are also reinforced by thin marginal flanges 26.

The support wall 16 has a U-shaped channel 28 that extends inwardly from its forward edge 30, and it has right angle flange portions 32 extending along the lateral edges, to provide a pair of spaced channel portions 34 contiguous to the undersurface of the wall 16. The same surface is tapered along the margins of the forward portion of the channel 28, to provide a guide surface 36 along each side thereof; the function of these surfaces will be described hereinbelow.

The locking slide member 12 consists of a plate portion 38 and a short, upstanding forward wall 40 extending perpendicularly thereto. The plate 38 has tongue elements 42 extending along its lateral edges, which are tapered inwardly at 44 and upwardly at 46. The plate portion 38 also includes a pair of prongs 48, which have upstanding locking dogs 50 at their free ends and which partially define the sides of a U-shaped slot 52. As will be noted, the prongs 48 are separated from the remainder of the plate 38 by narrow channels 54, thus permitting them to flex independently, as necessary to permit facile insertion and locking of the slide member 12 upon the bracket member 10.

Figure 3:
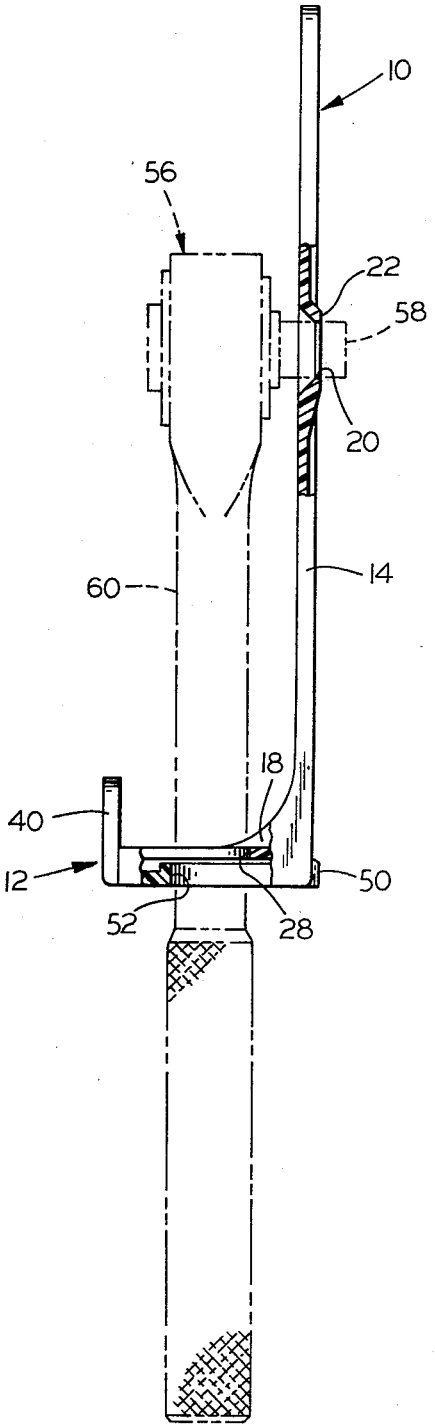
FIG. 3 is a side elevation view of the assembly of the foregoing figures, in partial section and with a contained socket driver shown in phantom line.
Figure 4:
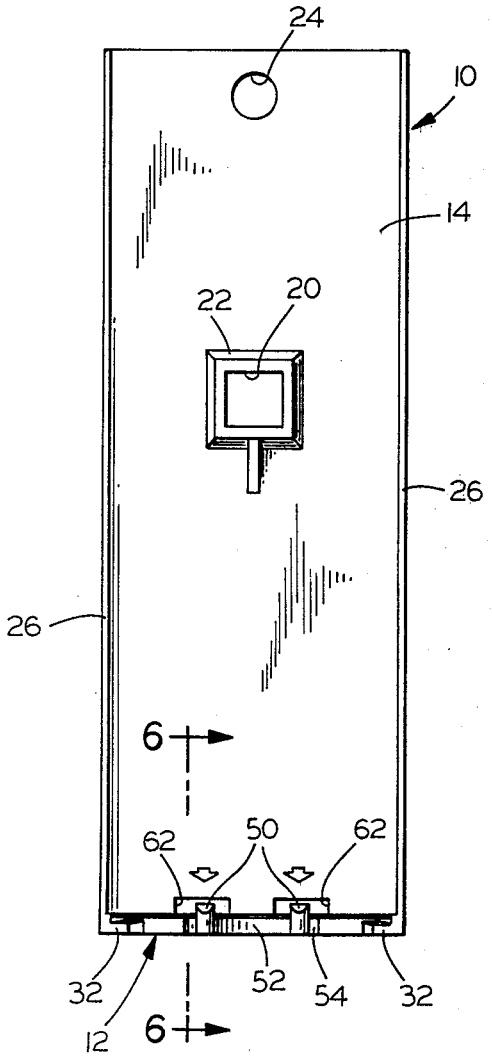
FIG. 4 is a rear elevational view of the assembly of the foregoing Figure.
Figure 6:
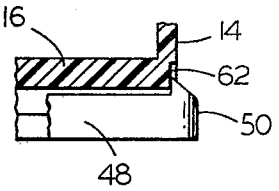
FIG. 6 is a fragmentary cross-sectional view, taken along line 6—6 of FIG. 4 and drawn to an enlarged scale, showing the engagement of one of the locking prongs behind the support wall of the bracket member.
Figure 5:
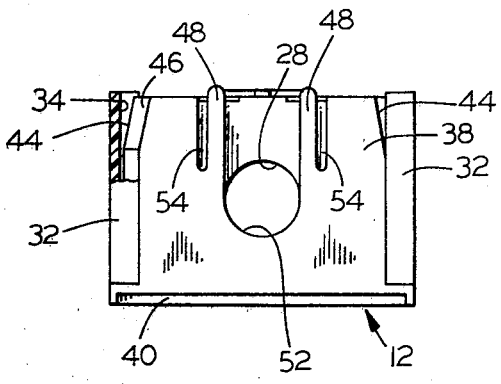
FIG. 5 is a bottom plan view of the assembly, with part of the support wall portion being broken away to illustrate one of the lateral channel portions formed therein.
Figure 8:
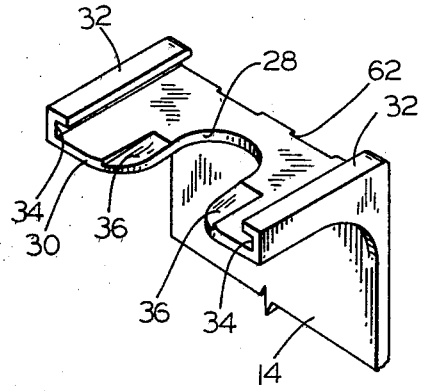
FIG. 8 is a fragmentary perspective view of the lower portion of the bracket member, in a position inverted from normal.
Figure 7:
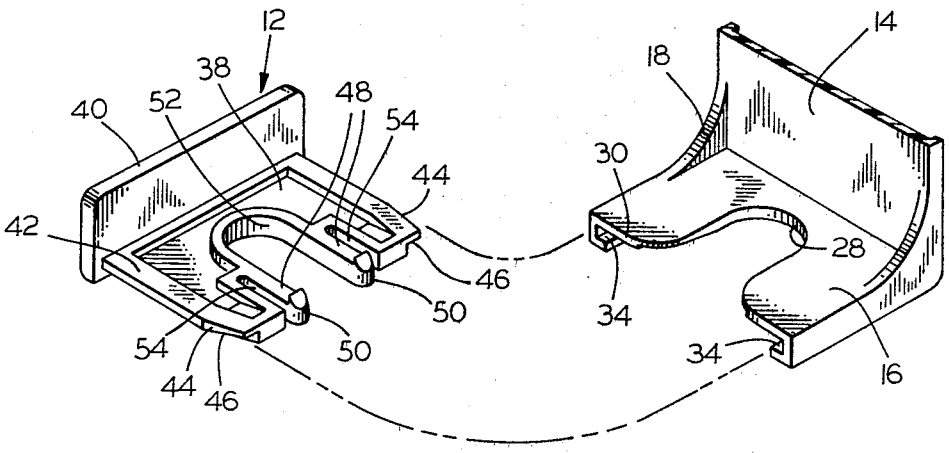
FIG. 7 is an exploded, fragmentary perspective view of the lower portion of the bracket member and the locking slide plate assembled therewith.

As will most readily be appreciated by reference to FIG. 3, the packaged socket driver, generally designated by the numeral 56, is mounted within the assembly by initially inserting the laterally extending square stub shaft portion 58 on the head thereof through the square opening 20 in the rear wall 14 of the bracket 10. The cylindrical handle portion or shank 60 is then placed into the U-shaped channel 28 in the support wall 16, following which the slide lock 12 is inserted. To do so, the leading edge of the plate portion 38 is initially aligned within the confronting channel portions 34, and is tilted upwardly through a slight angle; alignment and tilting of the member 12 are facilitated by the presence of the tapered surfaces at 44 and 46, respectively. In that position, the bevelled edges of the locking dogs 50 on the prongs 48 bear upon the glide surfaces 36, so that upon further inward movement the prongs 48 are properly guided across the under surface of the support wall 16, without binding or interference. When the slide lock member 12 reaches its fully inserted position, the dogs 50 snap into the shallow notches 62 which are formed into the back surface of the bracket 10 (at the juncture between the rear wall 14 and the support wall 16 thereof), thereby effecting secure interengagement. In that condition, the U-shaped channel 28 and slot 52 of the support wall 16 and slide plate 38, respectively, cooperatively define a generally circular aperture (best seen in FIGS. 2 and 5), within which the handle portion 60 of the socket driver 56 is trapped. The thus mounted tool can, however, readily be removed simply by withdrawing the slide member 12, which is achieved by depressing the prongs 48 to release them from the notches 62, as indicated by the two small arrows depicted in FIG. 4. The tool can, of course, readily be remounted by inserting the stub shaft 58 into the square opening 22, and thereafter replacing the locking slide 12 in the manner described.

Figure 9:
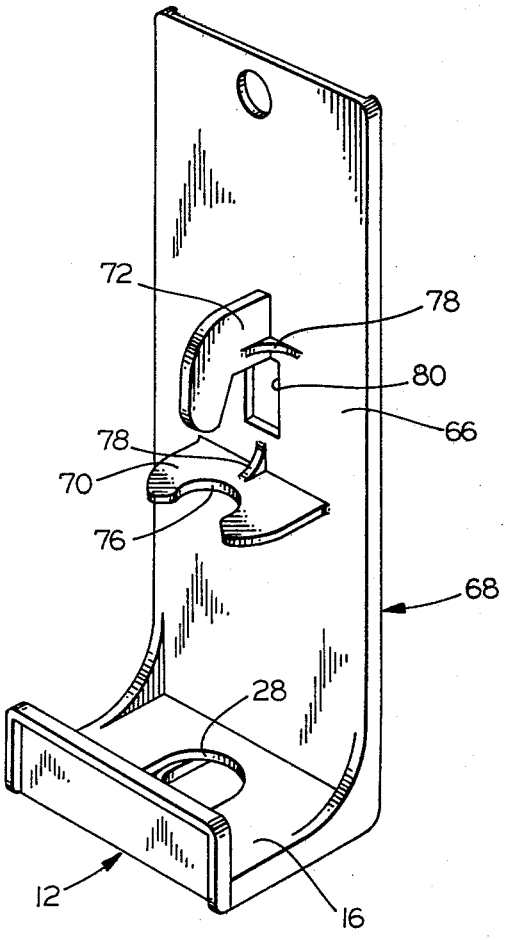
FIG. 9 is a perspective view of a second embodiment of the bracket assembly of the invention, adapted to hold a socket extension.
Figure 10:
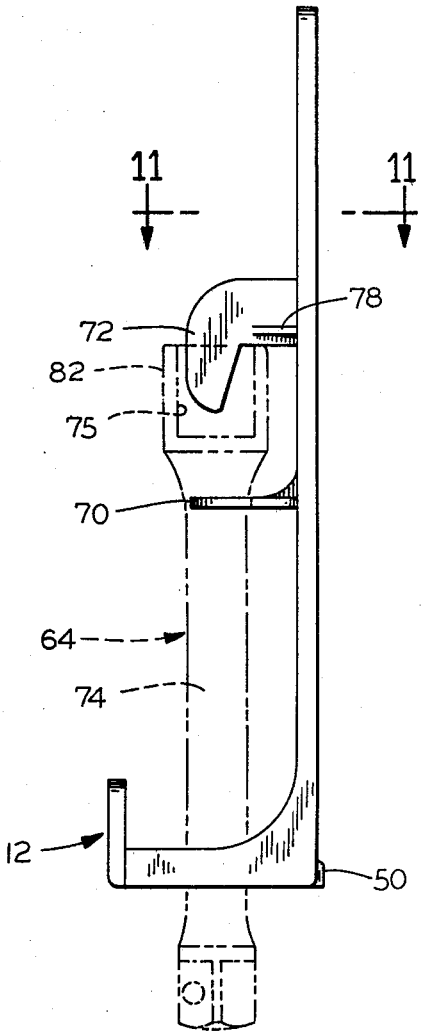
FIG. 10 is a side elevational view of the bracket assembly of FIG. 9, with a mounted socket extension shown in phantom line.
Figure 11:
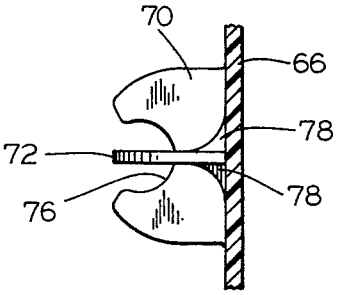
FIG. 11 is a fragmentary cross-sectional view of the rear wall portion of the bracket of the foregoing figures, taken along line 11—11 of FIG. 10.

The second embodiment, illustrated in FIGS. 9–11, functions in essentially the same manner to lock the tool in place, which tool is, in this instance, the socket extension which is generally designated by the numeral 64 in FIG. 10. Accordingly, the assembly need not be described in detail, and the numbers that are used in connection with FIGS. 1–8 are again employed to designate structure that is common to both embodiments. The essential difference between the two forms of assemblies resides in the means used to secure the head portion of the tool to the rear wall of the bracket, since the tools differ and therefore lend themselves to support in different ways.

More particularly, in this instance the rear wall 66 of the L-shaped bracket member, generally designated by the numeral 68, has a projecting shelf or collar 70 and a hook-shaped finger 72 disposed thereabove. As can be seen in FIG. 10, the shank portion 74 of the drive extension 64 is received within the semi-circular or C-shaped opening or slot 76 of the collar 70, with the head portion 82 of the tool resting thereupon and with the finger 72 received within the socket recess 75 formed in the head portion. Suitable web elements 78 are provided for structural strength, and a rectangular opening 80 is formed through the wall 66 to facilitate molding of the finger 72 by conventional means. As will be appreciated, mounting of the tool is achieved by first inserting the downwardly projecting end portion of the finger 72 into the axial socket opening 75 of the head portion, and thereafter pivoting the tool 64 to engage the shank portion 74 in the slot 76 and channel 28 of the collar 70 and the support wall 16, respectively. The slide 12 will then be inserted to lock the socket driver 64 in place, in the manner previously described with reference to FIGS. 1–8.

Figure 12:
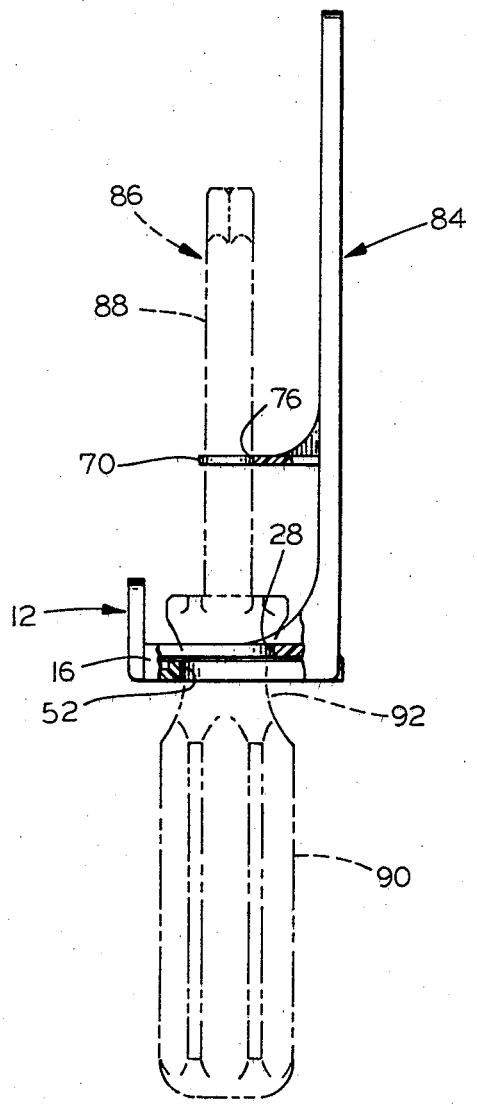
FIG. 12 is a side elevational view of a third embodiment of the bracket assembly of the invention, with a mounted socket spinner shown in phantom line.

Turning finally to FIG. 12, the illustrated bracket assembly, generally designated by the numeral 84, is adapted for packaging of a socket spinner, shown in phantom line as mounted in the assembly 84, and generally designated by the numeral 86. The assembly 84 is of a construction that is very similar to that of assembly 68 (shown in FIGS. 9–11), save for the elimination of the rear wall features above the collar 70, and dimensional variations. As will readily be appreciated, the shank portion 88 of the tool 86 is engaged within the C-shaped slot 76 of the collar 70; the collar partially encircles the shank portion and thereby fixes it against outward displacement. The handle 90 of the tool has a neck portion 92 of reduced diameter seated within the opening formed by the channel 28 of the support wall 16 and the slot 52 of slide member 12. The opening is of sufficiently small diameter to prevent axial displacement of the handle, thereby locking it in that sense as well as against outward displacement, and hence cooperating with the collar 70 to effect secure mounting of the spinner 86.

It will be appreciated by those skilled in the art that the bracket assembly of the invention can readily be produced by conventional molding techniques. A wide variety of plastics can be utilized in the construction, including the polystyrenes, polyolefines, polyesters, polyamides, and vinyl chloride polymers and copolymers, provided that they afford the requisite levels of strength, flexibility, and toughness, consistent with good economy; acrylonitrile/butadiene/styrene copolymers are particularly preferred. Structural variations in the parts of the bracket may result from the production practices used, but these will, once again, be evident to those skilled in the art.

Thus, it can be seen that the present invention provides a novel display bracket assembly for holding a socket drive unit (e.g., a driver, an extension, or a spinner), which bracket assembly is adapted for packaging of the article to protect it against damage, while securely holding the article and presenting it to the consumer in an attractive manner. The device retains the packaged tool and discourages pilferage, but nevertheless permits facile removal by the customer. In addition, the assembly serves for both point of sale display and also for subsequent storage of the article; it is, moreover, relatively simple and is adapted for facile and inexpensive manufacture. The invention also provides a novel display package in which an elongated tool is held within a bracket assembly, and is thereby protected and presented to the customer in an attractive and yet secure manner.

Having thus described the invention, what is claimed is:

1. A display bracket assembly for holding an elongated tool, comprising: a generally L-shaped bracket member including a rear wall and a laterally extending, generally planar support wall adjacent one end thereof, said rear wall having means spaced above said support wall for engaging a first portion of the tool, and said support wall having a channel extending longitudinally therethrough and inwardly from one edge thereof for receiving a second portion of the tool; a displaceable slide member slidably engaged on said support wall of said bracket member and including a portion extending transversely of said channel along said one edge of said support wall, said element blocking said channel to thereby trap the second portion of the tool within said support wall and to thereby prevent removal of the tool when said slide member is in place; and interengaging means on said bracket member and slide member for disengageably locking them in assembly.

2. The assembly of claim 1 wherein the first portion of the tool is a head portion and the second portion thereof is an elongated shank portion extending therefrom, said engaging means of said rear wall comprising seating means for the head portion.

3. The assembly of claim 2 wherein said seating means of said rear wall comprises an opening that is dimensioned and configured to seat therein a laterally projecting part of the tool head portion.

4. The assembly of claim 3 wherein said opening is square.

5. The assembly of claim 2 wherein said seating means comprises a hook-shaped member projecting towards said support wall, and a support collar disposed adjacent said hook-shaped member and towards said support wall, said assembly being adapted to hold a socket extension with the head portion thereof supported on said collar and with said hook member inserted into the axial socket opening thereof.

6. The assembly of claim 2 wherein the first portion of the tool is a shank portion and wherein the second portion thereof is a handle section of reduced cross-section relative to adjacent sections of the handle, said engagement means comprising a support collar adapted to partially encircle the tool shank portion, and said traversely extending portion of said bracket member and said support wall channel cooperatively defining an opening for receiving the handle section of the tool in close-fitting engagement, locking the tool within said support wall against axial as well as outward displacement.

7. The assembly of claim 1 wherein said locking means includes at least one tab portion on one of said bracket member and said slide member, said tab portion engaging the other of said members and being resiliently deflectable to permit facile disengagement therefrom.

8. The assembly of claim 7 said slide member includes a plate that is slidably engaged upon said support wall, said plate having a slot extending inwardly from the edge thereof spaced from said one edge of said support wall, said slot cooperating with said channel of said support wall to define an opening through which the tool second portion passes.

9. The assembly of claim 8 wherein said channel of said support wall and said slot of said plate are both of generally U-shaped configuration, said opening for the tool shank defined thereby being substantially circular.

10. The assembly of claim 8 wherein said plate of said slide member is disposed against said support wall, and wherein said tab portion comprises a resiliently deflectable prong on said slide member, said prong including a locking dog snap fit behind the other end of said support wall of said bracket member.

11. The assembly of claim 10 said slide member has two of said prongs in part defining the sides of said slot in said plate, and wherein the adjacent surface of said support wall, contiguous to said channel therein, has tapered surface portions to provide a lead-in path to accommodate said locking dogs of said prongs.

12. The assembly of claim 8 wherein said support wall includes a pair of confronting parallel channel portions on the surface threof spaced from said seating means for engagement of said slide member, and wherein side edges of said plate of said slide member are dimensioned and configured for sliding movement within said channel portions.

13. The assembly of claim 12 wherein the portions of said side edges of said plate adjacent said one end thereof are tapered both inwardly and also towards said engaging means, said inward taper facilitating lateral entry of said slide member into said channel portions, and the second taper permitting facile entry of said slide member angled towards said seating means.

14. A display package for a tool, including (a) an elongated tool; and (b) a display bracket assembly comprising: (1) a generally L-shaped bracket member including a rear wall and a laterally extending, generally planar support wall adjacent the lower end thereof, said rear wall having means spaced above said support wall for engaging a first portion of the tool, and said support wall having a channel extending longitudinally therethrough and inwardly from one edge thereof for receiving a second portion thereof, (2) a displaceable slide member slidably engaged on said support wall of said bracket member and including a portion extending transversely of said channel along side one edge of said support wall, said first portion of said tool engaged with said engaging means of said support wall, said second portion thereof being received within said channel of said support wall, and said transverse portion of said slide member blocking said channel and thereby trapping said second portion of said tool within said support wall to thereby prevent removal of the tool when said slide member is in place; and (3) interengaging means on said bracket and slide member for disengageably locking them in assembly.

15. The package of claim 14 wherein said engaging means of said rear wall of said bracket member is a square opening, and wherein said tool first portion is a head portion having a laterally projecting socket-engaging stub shaft of square cross-section, said tool being a socket driver and said opening being dimensioned and configured to receive said stub shaft therewithin.

16. The package of claim 14 wherein said engaging means of said rear wall of said bracket member comprises a hook-shaped member projecting toward said support wall, and a support collar disposed adjacent said hook-shaped member and towards said support wall, said tool being a socket extension, said first portion thereof being a head portion supported on said collar, and said hook-shaped member being inserted into the axial socket opening thereof.

17. The package of claim 14 wherein said first portion of said tool comprises a shank portion of circular cross-section and said second portion thereof comprises a handle section of reduced cross-section relative to adjacent sections of the handle, said engaging means of said rear wall of said bracket member comprising a support collar adapted to partially encircle said shank portion, and said transversely-extending portion of said bracket member and said support wall channel cooperatively defining an opening for receiving said handle section in close-fitting engagement, locking said tool within said support wall against axial as well as outward displacement.

18. The package of claim 14 wherein said support wall of said bracket member has a U-shaped channel formed therein, and said slide member has a generally U-shaped slot formed thereinto, said channel and slot being disposed in confronting relationship to cooperatively define a generally circular aperture, said tool second portion being substantially cylindrical.

19. The package of claim 14 wherein said locking means includes at least one tab portion on one of said bracket member and said slide member, said tab portion engaging the other of said members and being resiliently deflectable to permit facile disengagement therefrom.

20. The package of claim 19 wherein said slide member includes a plate that is slidably engaged upon said support wall, said plate having a slot extending inwardly from the one edge thereof spaced from said one edge of said support wall, said slot cooperating with said channel of said support wall to define an opening through which said tool second portion passes.

21. The assembly of claim 20 wherein said support wall includes a pair of confronting parallel channel portions on the surface thereof spaced from said engaging means for engagement of said slide member, and wherein side edges of said plate of said slide member are dimensioned and configured for sliding movement within said channel portions.

22. A display bracket assembly for holding an elongated tool, comprising: a generally L-shaped bracket member including a rear wall and a laterally extending support wall adjacent one end thereof, said rear wall having means spaced above said support wall for engaging a first portion of the tool, and said support wall having a channel extending longitudinally therethrough and inwardly from one edge thereof for receiving a second portion of the tool; a displaceable slide member slidably engaged on said support wall of said bracket member and including a portion extending transversely of said channel along said one edge of said support wall, said element blocking said channel to thereby trap the second portion of the tool within said support wall and to thereby prevent removal of the tool when said slide member is in place; and means for disengageably locking said slide member in assembly with said bracket member, said locking means including at least one resiliently deflectable prong on said slide member having a locking dog adjacent its free end, said locking dog being snap fit behind the end of said bracket member support wall opposite to said one edge thereof.

23. The assembly of claim 22 wherein said slide member includes a plate that is disposed against, and slidably engaged upon, said support wall, said plate having a slot extending inwardly from the edge thereof spaced from said one edge of said support wall and cooperating with said channel of said support wall to define an opening through which the tool second portion passes.

24. The assembly of claim 23 wherein said channel of said support wall and said slot of said plate are both of generally U-shaped configuration, said opening defined thereby being substantially circular, and wherein said slide member has two of said prongs in part defining the sides of said slot in said plate.

25. The assembly of claim 24 wherein the adjacent surface of said support wall, contiguous to said channel therein, has tapered surface portions to provide a lead-in path to accommodate said locking dogs of said prongs, wherein said support wall includes a pair of confronting parallel channel portions on the surface thereof spaced from said engaging means for engagement of said slide member, wherein side edges of said plate of said slide member are dimensioned and configured for sliding movement within said channel portions, and wherein the portions of said side edges of said plate adjacent said one end thereof are tapered both inwardly and also towards said engaging means, said inward taper facilitating lateral entry of said slide member into said channel portions, and the second taper permitting facile entry of said slide member angled towards said engaging means.

* * * * *